US007293613B2

(12) United States Patent
Goldberg et al.

(10) Patent No.: US 7,293,613 B2
(45) **Date of Patent: *Nov. 13, 2007**

(54) LOGGING-WHILE-CORING METHOD AND APPARATUS

(75) Inventors: David S. Goldberg, New York, NY (US); Gregory J. Myers, Cornwall, NY (US)

(73) Assignee: The Trustees of Columbia University, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/639,551

(22) Filed: Dec. 15, 2006

(65) Prior Publication Data

US 2007/0107939 A1 May 17, 2007

Related U.S. Application Data

(63) Continuation of application No. 10/850,691, filed on May 21, 2004, now Pat. No. 7,168,508.

(60) Provisional application No. 60/499,265, filed on Aug. 29, 2003.

(51) Int. Cl.
*E21B 49/02* (2006.01)
*E21B 47/00* (2006.01)

(52) U.S. Cl. ..... 175/50; 175/58; 175/246

(58) Field of Classification Search ..... 175/44, 175/50, 58, 246
See application file for complete search history.

(56) References Cited

U.S. PATENT DOCUMENTS

| | | | |
|---|---|---|---|
| 2,820,610 | A | 1/1958 | Martinez |
| 4,499,955 | A | 2/1985 | Campbell et al. |
| 4,601,354 | A | 7/1986 | Campbell et al. |
| 4,955,438 | A | 9/1990 | Juergens et al. |
| 5,010,765 | A | 4/1991 | Duckworth et al. |
| 5,351,765 | A | 10/1994 | Ormsby |
| 5,568,838 | A | 10/1996 | Struthers et al. |
| 5,984,023 | A | 11/1999 | Sharma et al. |

(Continued)

FOREIGN PATENT DOCUMENTS

| | | |
|---|---|---|
| WO | WO 01/53855 A1 | 7/2001 |

OTHER PUBLICATIONS

Lovell et al., Structural Interpretation of Resistivity-at-the-Bit Images, SPWLA 36th Annual Logging Symposium, Jun. 26-29, 1995.

(Continued)

*Primary Examiner*—Hoang Dang
(74) *Attorney, Agent, or Firm*—Wilmer Cutler Pickering Hale and Dorr LLP

(57) ABSTRACT

A method and apparatus for downhole coring while receiving logging-while-drilling tool data. The apparatus includes core collar and a retrievable core barrel. The retrievable core barrel receives core from a borehole which is sent to the surface for analysis via wireline and latching tool The core collar includes logging-while-drilling tools for the simultaneous measurement of formation properties during the core excavation process. Examples of logging-while-drilling tools include nuclear sensors, resistivity sensors, gamma ray sensors, and bit resistivity sensors. The disclosed method allows for precise core-log depth calibration and core orientation within a single borehole, and without at pipe trip, providing both time saving and unique scientific advantages.

20 Claims, 8 Drawing Sheets

U.S. PATENT DOCUMENTS

| | | | |
|---|---|---|---|
| 6,003,620 | A | 12/1999 | Sharma et al. |
| 6,006,844 | A | 12/1999 | Van Puymbroeck et al. |
| 6,220,371 | B1 | 4/2001 | Sharma et al. |
| 6,788,066 | B2 | 9/2004 | Wisler et al. |

OTHER PUBLICATIONS

Corsaires, Coring Stable and Instable Realms in European Seas, 4th Workshop, Measurement While Coring, Lisbon, Portugal on May 24, 1998.

Rack et al., Joint Oceanographic Institutions, Technical Progress Report #1 to DOE/NETL for Oct.—Dec. 2001, Cooperative Agreement DE-FC26-01NT41329, provided to DOE/NETL in Feb. 2002.

Bohrmann et al., Ocean Drilling Program, Leg 204, Scientific Prospectus, Drilling Gas Hydrates on Hydrate Ridge, Cascadia Continental Margin, http://www-odp.tamu.edu/publications/prosp/204_prs/204toc.html, posted on Feb. 27, 2002.

JOIDES Science and Operations Committees, Yokohama, Japan on Mar. 19-20, 2002.

Ocean Drilling Program, Quarterly Report to Joint Oceanographic Institutions for Jan.—Mar. 2002, Contract No. JSC 2-94, provided to Joint Oceanographic Institutions on Apr. 20, 2002.

Ocean Drilling Program, Quarterly Report to Joint Oceanographic Institutions for Apr.—Jun. 2002, Contract No. JSC 2-94, provided to Joint Oceanographic Institutions on Jul. 20, 2002.

Ocean Drilling Program, Quarterly Report #127 to National Science Foundation for Apr.—Jun. 2002, Contract No. OCE-9308410, provided to National Science Foundation on Jul. 31, 2002.

Rack et al., Joint Oceanographic Institutions, Technical Progress Report #3 to DOE/NETL for Apr.—Jun. 2002, Cooperative Agreement DE-FC26-01NT41329, provided to DOE/NETL in Aug. 2002.

JOIDES Science Committee, Ghent, Belgium on Aug. 26, 2002.

Bonnecaze et al., High Resolution Downhole Measurements of Porosity and Fluid Saturation While Core Drilling, SPE Annual Technical Conference and Exhibition, San Antonio, Texas, Sep. 29-Oct. 2, 2002.

Ocean Drilling Program, Quarterly Report to Joint Oceanographic Institutions for Jul.—Sep. 2002, Contract No. JSC 2-94, provided to Joint Oceanographic Institutions on Oct. 21, 2002.

Rack et al., Joint Oceanographic Institutions, Technical Progress Report #4 to DOE/NETL for Jul.—Sep. 2002, Cooperative Agreement DE-FC26-01NT41329, provided to DOE/NETL in Nov. 2002.

Ocean Drilling Program, Leg 204, Downhole Logging Summary, Drilling Gas Hydrates on Hydrate Ridge, Cascadia Continental Margin, http://www.ldeo.columbia.edu/BRG/ODP/ODP/LEG_SUMM/204/leg204.html, posted on Nov. 4, 2002.

Kelemen et al., Ocean Drilling Program, Leg 209, Scientific Prospectus, Drilling Mantle Peridotite along the Mid-Atlantic Ridge from 14° to 16°N, http://www-odp.tamu.edu/publications/prosp/209_prs/209toc.html, posted on Nov. 21, 2002.

Ocean Drilling Program, Leg 204, Preliminary Report, Drilling Gas Hydrates on Hydrate Ridge, Cascadia Continental Margin, http://www-odp.tamu.edu/publications/prelim/204_prel/204toc.html, posted on Dec. 5, 2002.

Ocean Drilling Program, Quarterly Report to Joint Oceanographic Institutions for Oct.—Dec. 2002, Contract No. JSC 2-94, provided to Joint Oceanographic Institutions on Jan. 20, 2003.

JOIDES Science Committee, Austin, Texas on Mar. 17, 2003.

Ocean Drilling Program, Quarterly Report to Joint Oceanographic Institutions for Jan.—Mar. 2003, Contract No. JSC 2-94, provided to Joint Oceanographic Institutions on Apr. 20, 2003.

Goldberg et al., Logging-while-coring—New Technology Advances Scientific Drilling, SPWLA Annual Symposium, Galveston, Texas on Jun. 22-25, 2003.

Ocean Drilling Program, Quarterly Report to Joint Oceanographic Institutions for Apr.—Jun. 2003, Contract No. JSC 2-94, provided to Joint Oceanographic Institutions on Jul. 20, 2003.

Rack et al., Joint Oceanographic Institutions, Technical Progress Report #7 to DOE/NETL for Apr.—Jun. 2003, Cooperative Agreement DE-FC26-01NT41329, provided to DOE/NETL in Aug. 2003.

Goldberg et al., Ocean Drilling Program Pioneers Technology for Logging While Coring, The American Oil & Gas Reporter, Sep. 2003, pp. 103-107.

Rack, In-Situ Sampling and Characterization of Naturally-Occurring Marine Methane Hydrate: ODP Leg 204, Hydrate Ridge, DOE/NETL Project Review Meeting, Winchester, Colorado on Sep. 29-30, 2003.

Ocean Drilling Program, Leg 209, Preliminary Report, Drilling Mantle Peridotite along the Mid-Atlantic Ridge from 14° to 16°N, http://www-odp.tamu.edu/publications/prelim/209_prel/209PREL.PDF, posted on Oct. 3, 2003.

LOGGING-WHILE-CORING METHOD AND APPARATUS

CROSS-REFERENCE TO RELATED APPLICATIONS

This application is a continuation of U.S. patent application Ser. No. 10/850,691, filed May 21, 2004 (now U.S. Pat. No. 7,168,508), which claims priority under 35 U.S.C. §119(e) to U.S. Provisional Patent Application No. 60/499,265, filed on Aug. 29, 2003, entitled SYSTEM FOR PERFORMING DOWNHOLE LOGGING WHILE CORING, both of which are expressly incorporated herein by reference in their entireties.

STATEMENT AS TO FEDERALLY SPONSORED RESEARCH OR DEVELOPMENT

The invention described herein was made at least in part with U.S. government support under Contract No. JSC 2-94, which was awarded by the U.S. National Science Foundation to Joint Ocean Institutions, Inc. and subcontracted to the assignee and under Contract No. JSC 2-06, which was awarded by the U.S. Department of Energy to Joint Ocean Institutions, Inc. and subcontracted to the assignee. Accordingly, the government may have certain rights in the subject invention.

BACKGROUND

1. Technical Field

The invention relates generally to a method and apparatus for wellbore coring and logging. More particularly, this invention relates to a method and apparatus for collecting data regarding geological properties of underground or undersea formations during coring operations.

2. Discussion of Related Art

The desirability of a system which is able to measure downhole formation properties while simultaneously coring a geological sample has long been recognized. Until now it has not been possible to continuously collect large diameter core and in situ logging data simultaneously.

Geologists and geophysicists collect data regarding underground formations in order to predict the location of hydrocarbons (e.g., oil and gas). Traditionally, such information is gathered during an exploration phase. In recent years, however, the art has advanced to allow the collection of geophysical and geological data as a well is being drilled. These logging-while-drilling (LWD) measurements are typically made following coring in a separate borehole. Logging data are correlated to the core sample. Correlation accuracy depends on the yield recovery of the core and sample/data match-up. There is a pressing need in the industry for more accurate formation property data, such as provided by correlation of the core to a downhole data set.

Known systems (e.g., logging-while-drilling) use a series of tubes, referred to as drill pipe and collars, to drill a hole into the formation. The lower end of the drill string, called the bottomhole assembly, is provided with a cutting mechanism, referred to as drill bit, which has a concentric hole. A drill collar, disposed proximally to the drill bit, includes several formation properties sensors, referred to as an LWD tool. Formation property measurements are recorded in this LWD tool.

When a sample of the formation is required, a coring device is lowered inside the drill string and secured at the bottom end. By resuming drilling and/or pumping fluid down the drill string, the coring process is effected. The coring device is retrieved by a latching mechanism attached to a wireline.

Continuous wireline-retrievable coring, for example, is routine in nearly all Ocean Drilling program (ODP) drill holes, whereas industry coring programs are often limited in key intervals due to time and cost constraints. The ODP routinely drills holes up to 2000 m deep without a riser in water depths ranging from 300 m to 6000 m. Sea water is utilized at high pressure to clear the hole of cuttings. Conventional wireline logging tools are typically deployed if hole conditions are good. In cases where drilling is expected to be difficult, LWD technologies are employed in another hole in close proximity to the core hole. A dedicated LWD hole is often the only alternative to collect in situ log data in such difficult drilling environments.

In order to obtain logging-while-drilling data and a closely correlated core sample, the prior art requires two holes to be drilled. A first hole is drilled to collect a core sample. A coring bottomhole assembly is used to simultaneously drill a hole and core out a core column. A second hole, laterally spaced from the first hole, is drilled using a traditional logging-while-drilling bottomhole assembly. Logging-while-drilling tools measure formation properties of borehole that are, in theory, supposed to be closely correlated to the previously extracted core sample.

The prior art exhibits two significant disadvantages. The above described method is time consuming because it requires two separate drill holes: a first hole for obtaining core samples and a second hole for obtaining logging-while-drilling data. Specifically, a downhole coring assembly must be lowered to the ocean floor, in order to drill/core the first hole. Subsequently, the downhole coring assembly is raised to the surface so that a retooling can be executed. A logging-while-drilling downhole assembly is then lowered back down to the ocean floor in the area of the first hole. Following the positioning of the logging-while-drilling downhole assembly, the assembly drills the second hole while performing logging-while-drilling measurements. The time required in refitting the drillstring with the logging-while-drilling assembly and in drill the second hole adds to the total operating costs and time duration of this coring and logging operation.

The second disadvantage is the possible detrimental effect on the data correlation. Correlating a core sample with formation property data assumes that the data and sample are obtained from same location or even the same hole. When the logging data and core sample are obtained from different holes that are often located some distance from each other, one's ability to correlate the logging data with the core sample to obtain accurate result can be adversely affected.

SUMMARY OF THE INVENTION

A new logging-while-coring technology is proposed. A primary object of the present invention is the reduction of time required to log after drilling and coring has been completed in a hole. Another object of the present invention is to make in situ measurements using LWD over the same cored interval in a particular hole. Merging state-of-the-art wireline coring and logging while drilling technologies provides two vital data sets without sacrificing time or adding risk associated with longer open hole times.

The invention relates primarily to a downhole rotary coring device placeable in a drill string and having a head section, a drill collar, and a core barrel having LWD tools disposed within the drill collar. The coring device is used to obtain a sample of an earth formation. The invention provides a combined downhole coring device with a collar for performing LWD measurements.

The coring device has a core barrel with a coring bit at the lower end, which cuts an annular hole into the formation. The resulting pillar of rock enters the core barrel and held in place by a core catcher.

Formation property measurements are executed during the coring process. Formation property sensors are powered by an internal battery contained within the drill collar. Formation property data are stored in a memory storage device, such as, Random Access Memory (RAM), and/or communicated to a data transmission system.

The purpose of the present invention is to propose a solution to the problem set out above. One object of the invention is to procure a collar that allows both a core barrel pass through it and is able to perform logging-while-drilling measurements.

According to one aspect of the invention, a downhole assembly for performing logging operations while coring includes a core bit disposed at a distal end of the assembly and a core barrel having an inner surface and an outer surface. The core barrel is coupled to the core bit. The assembly further includes a collar having an inner surface and an outer surface and at least one logging sensor. The inner surface of the collar allows the outside surface of the core barrel to pass through it. At least one logging sensor is disposed on the outer surface of the collar.

According to another aspect of the invention, the downhole assembly further includes logging-while-drilling tools.

According to another aspect of the invention, the downhole assembly further includes a core catcher.

According to another aspect of the invention, the downhole assembly further includes one or more crossovers.

According to another aspect of the invention, the downhole assembly further includes one or more jarring devices.

According to another aspect of the invention, the downhole assembly further includes one or more stabilizers.

According to another aspect of the invention, the downhole assembly further includes a battery powering at least one of the logging sensors.

According to another aspect of the invention, the battery is disposed within the collar.

According to another aspect of the invention, the core barrel is powered by a motor, or another driving mechanism.

According to another aspect of the invention, the downhole assembly is disposed in a drillstring.

According to another aspect of the invention, the logging sensors measures formation properties of the surface of the wellbore.

According to another aspect of the invention, the logging sensors includes one or more sensors from a group consisting of: resistivity sensor; passive nuclear sensor; active nuclear sensor; gamma ray sensor; electromagnetic wave sensor; electric field telemetry sensor; acoustics sensor; and nuclear magnetic resonance sensor.

According to another aspect of the invention, the logging sensor communicates with a data transmission device.

According to another aspect of the invention, logging data is stored in a memory storage device.

According to another aspect of the invention, a method for executing logging measurement while performing coring operation is disclosed. The method includes providing a bottomhole assembly, coring a wellbore, and receiving measurements from one or more logging tools. At least one logging tool measures a formation property of a wellbore.

According to another aspect of the invention, the method for executing logging measurement while performing coring operation further includes the step of communicating the measurements to a data transmission device.

According to another aspect of the invention, the method for executing logging measurement while performing coring operation further includes the step of storing the measurements in a memory storage device.

According to another aspect of the invention, the method for executing logging measurement while performing coring operation further includes the step of receiving measurements from a least one measurements-while-drilling tools.

According to another aspect of the invention, the method for executing logging measurement while performing coring operation further includes the step of communicating the measurements from at least one measurements-while-drilling tools to a data transmission device.

According to another aspect of the invention, the method for executing logging measurement while performing coring operation further includes the step of storing the measurements from at least one measurements-while-drilling tools in a memory storage device.

According to another aspect of the invention, a method for performing logging operations while coring includes the steps of excavating a core sample, capturing the core sample through a core bit into a core barrel, and activating at least one logging sensor. Each of the logging sensors measures one or more formation properties. The method further includes the step of receiving sensor measurements from at least one logging sensor.

According to another aspect of the invention, the method for performing logging operations while coring further includes the step of communicating the sensor measurements to a data transmission device.

According to another aspect of the invention, the method for performing logging operations while coring further includes the step of storing the sensor measurements in a memory storage device.

DETAILED DESCRIPTION

The present invention combines a coring system with logging-while-drilling system, both of which are known in the art.

Figure 1:
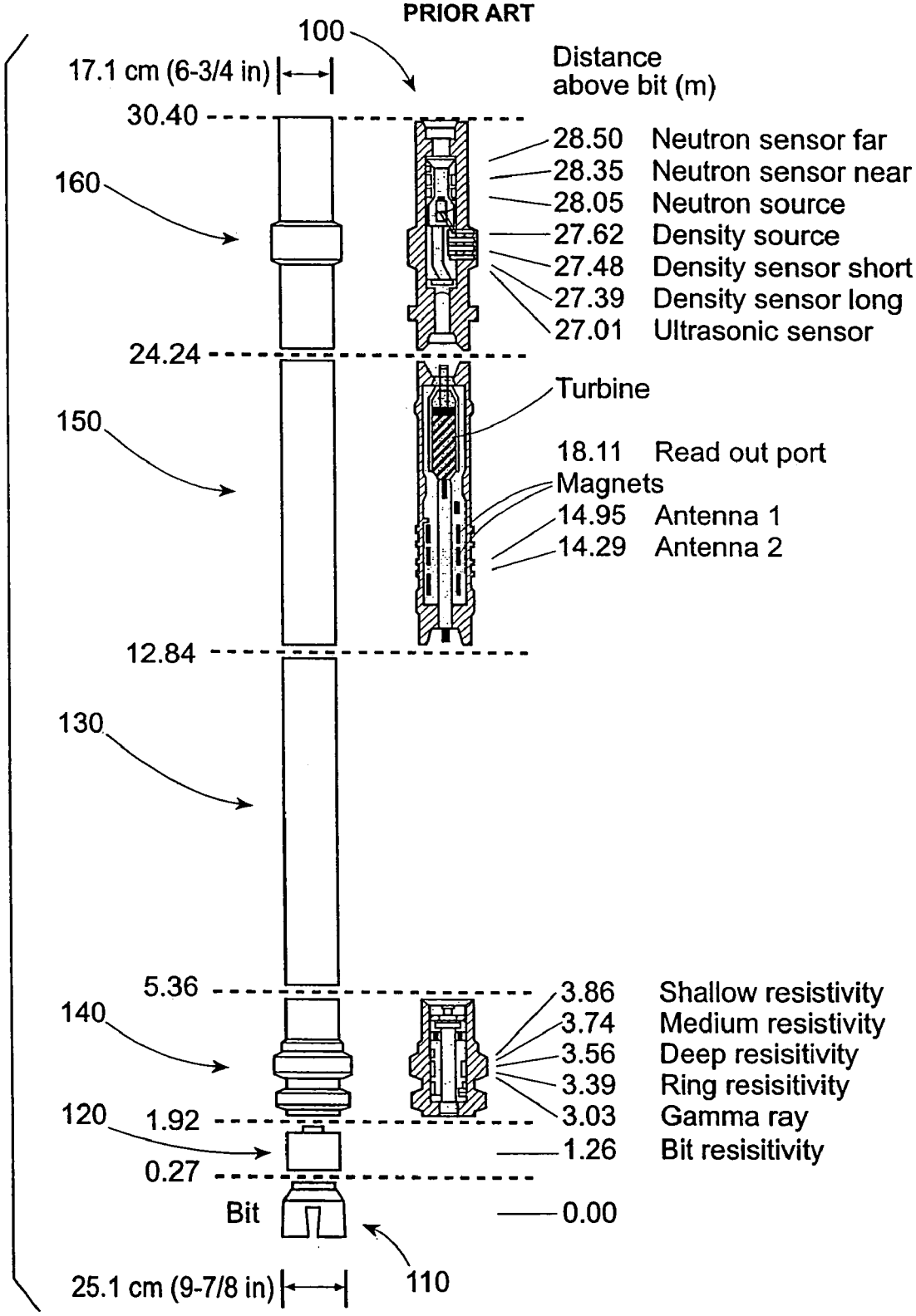
FIG. 1 PRIOR ART
FIG. 1 is a schematic of the prior art representing a logging-while-drilling downhole assembly.

A schematic of the prior art is depicted in FIG. 1. FIG. 1 illustrates a logging-while-drilling downhole assembly 100. The logging-while-drilling downhole assembly 100 includes a bit 110, a bit sub 120, a measurement-while-drilling section 130, a logging-while-drilling lower sub-assembly 140, a mechanically-rotatable-turbine section 150, and a logging-while-drilling upper sub-assembly 160.

Bit 110 is comprised of three rotatable heads that break up rock when a force is applied to the logging-while-drilling downhole assembly 100. Bit sub 120 is a pipe sub-assembly that couples the bit 110 to the rest of the logging-while-drilling downhole assembly 100.

Measurement-while-drilling (MWD) section 130 performs measurements such as sensing ambient pressure and weight on bit 110. Logging-while-drilling lower assembly 140 performs logging measurements, such as, sensing shallow resistivity, medium resistivity, deep resistivity, ring resistivity, and gamma rays. Mechanically-rotatable-turbine 150 includes a hydraulic turbine motor, read out port magnets, and antennas.

Logging-while-drilling upper assembly 160 performs logging measurements. Logging-while-drilling upper assembly 160 includes a far neutron sensor, a near neutron sensor, a neutron source. Logging-while-drilling upper assembly 160 further includes a long density sensor, a short density, a density source, and a ultrasonic sensor.

Figure 2:
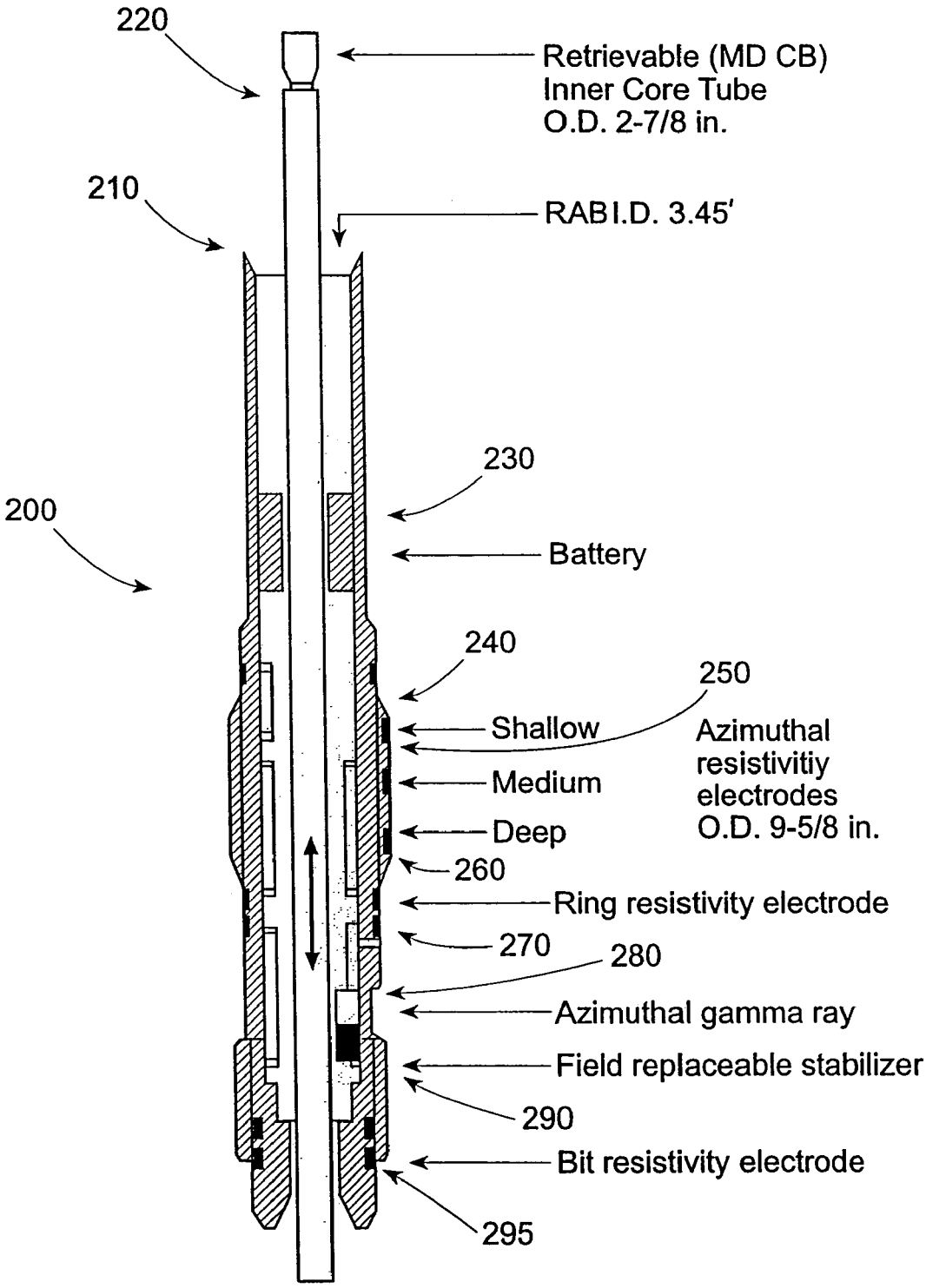
FIG. 2 is an illustration of a logging-while-coring downhole assembly.

FIG. 2 illustrates an embodiment of the present invention. Logging-while-coring downhole system 200 is disposed at the distal end of a drillstring (not shown) and is lowered into a wellbore to perform drilling, coring, and logging operations. Logging-while-coring downhole system 200 includes a core collar 210, a retrievable core barrel 220, a battery 230, a ring resistivity electrode 270, an azimuthal gamma ray detector 280, a field replaceable stabilizer 290, and bit resistivity electrode 295. Logging-while-coring downhole system 200 further includes a shallow azimuthal resistivity electrode 240, a medium azimuthal resistivity electrode 250, and a deep azimuthal resistivity electrode 260.

The current embodiment of the present invention was reduced to practice by selecting a core barrel to fit through the throat of a modified Schlumberger Resistivity-at-Bit ™ (RAB-8™) Tool. A core barrel (MDCB) 220 was selected to fit within the 3.45-inch annulus of the RAB-8. Minor modifications of the MDCB 220 were required to accommodate the tool length and latching mechanism.

A typical RAB-8 battery ordinarily occupies the annular space in the tool. The RAB-8 battery was redesigned to retain the annular space, allowing the MDCB 220 to pass through. A new resistivity button sleeve and slick stabilizer were fabricated to accommodate a 9 ⅞-inches bit size which is considerably smaller than conventional bits used with the RAB-8 collar. The tool standoff from the borehole wall for the core collar 210 is nominally 0.185-inches in the present configuration.

Referring to FIG. 2, the logging tools are disposed within the core collar 210. The battery 230 in the present embodiment powers the sensors (240, 270, 280, 295, etc.) and any memory storage devices (not shown), such as RAM, EEPROM, flash, etc. However, in alternate embodiments, power can be supplied from the surface through a wireline (not shown).

Retrievable MDCB 220 rotate circumferentially and is driven by a motor (not shown). Rock and sediment ingress into the hollow body of retrievable MDCB 220. Upon extraction of core from the wellbore into the retrievable MDCB 220, retrievable MDCB 220 is unlatched and brought to the surface via a tether (e.g., slickline). The retrievable MDCB 220 can be replaced in situ by running another core barrel down from the surface. Within the scope of the present invention, the core barrel is not limited to a retrievable motor driven core barrel 220. Other embodiments can include piston-type core barrel, a static core barrel, or non-retrievable core barrel.

Referring to FIG. 2, three azimuthal resistivity electrodes are illustrated. Shallow azimuthal resistivity electrode 240 senses the resistivity of the surrounding rock formation at a depth shallower relative to the other sensors. Medium azimuthal resistivity electrode 250 senses the resistivity of the surrounding rock formation at medium depth relative to the other sensors. Deep azimuthal resistivity electrode 240 senses the resistivity of the surrounding rock formation at a depth deeper relative to the other sensors. The resistivity sensors of the present embodiment functionally operate in similar manners. Resistivity of the surrounding formation is measured by applying a voltage to one or more electrodes and measuring the current passing through the electrode as a function of the voltage in accordance with Ohm's law. Ring resistivity electrode measures 270 performs a similar measurement using a ring-shaped electrode by measuring resistances of all azimuths around the borehole.

Azimuthal gamma ray detector 280 senses gamma rays propagating through the formation of the wellbore. Gamma rays are produced by the nuclear decay of clays in the surrounding formation. Field replaceable stabilizer 290 maintains the collar 210 centralized and stabilizes the collar 210 in the hole. Field replaceable stabilizer 290 is also able to be changed on the surface. Bit resistivity electrode 295 measures the resistivity of the formation at the bit.

Other embodiments may employ active nuclear sensors in the logging-while-coring system. For example, a neutron source for neutron bombardment and neutron detector may be used in the outer surface of the core collar. Another example includes a electron source for electron emission and electron detector may be used in the outer surface of the core collar.

Figure 3:
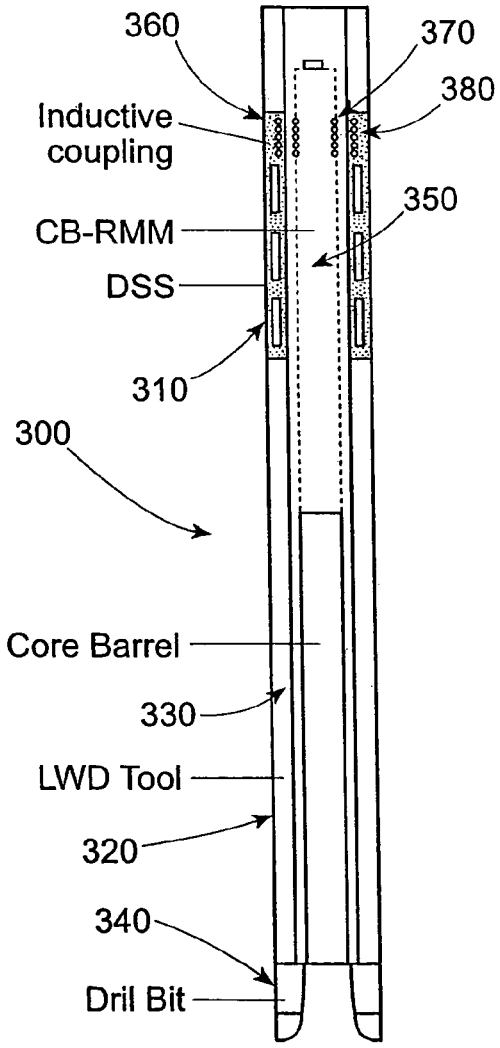
FIG. 3 is an illustration of an additional embodiment of a logging-while-coring downhole assembly with a retrievable memory module.

FIG. 3 illustrates an alternate embodiment of the present invention. Referring to FIG. 3, the logging-while-coring tool 300 includes a core barrel 330, a logging-while-drilling tool 320, a drill bit 340, a core barrel retrievable memory module 350, and an inductive coupler 370. The core barrel 330 and the retrievable memory module 350 are coupled to one another.

Logging-while-drilling tool 320 is similar in construction to the core collar 210 of the previous embodiment. Logging-while-drilling tool 320 includes drilling sensor sub assembly 310 and one or more logging tools (not shown) that are known in the art. Data from the logging tools (e.g., weight on bit, torque, and pressure) are communicated to the drilling sensor sub assembly 310. The drilling sensor sub assembly 310 communicates the data through the inductive coupler 370.

The inductive coupler comprises an inner inductor 370 and outer inductor 380. The inner inductor 370 and the outer inductor 380 are disposed in the core barrel retrievable memory module and the drilling sensor sub assembly 310, respectively. The outer inductor 380 transmits the logging data via an induced magnetic field which is produced by current passing through the outer inductor 380 in accordance with Ampere's law. The resultant magnetic field induces a current in the inner inductor 370 in accordance with Faraday's law. A retrievable memory module (not shown) of the core barrel retrievable memory module 350 recognizes and stores the signal received from the inner inductor 370.

In one or more embodiments, the drilling sensor sub assembly 310 transmits the data via the inductive coupler 360 whether the core barrel retrievable memory module 350 is present or not. In some embodiments, the core barrel retrievable memory module 350 performs and stores its own measurements in addition to the logging data received from the drilling sensor sub assembly 310. For example, the core barrel retrievable memory module 350 executes pressure and acceleration measurements which are stored with the data transmitted from the inductive coupler 360.

In the present embodiment, the retrievable memory module 350 includes a 64 MB flash memory chip. In other embodiments, the retrievable memory module can include one or more of a variety of memory-storage devices. Examples of memory storage devices include random access memory (RAM), electronically erasable programmable read only memory (EEPROM), and flash RAM.

The memory storage device stores the data received from the LWD tools and is downloadable at the surface following a logging-while-coring operation. During retrieval of the core barrel 330, the core barrel retrievable memory module 350 is also brought to the surface. The data corresponding to the sample contained in the core barrel is retrieved at the surface through a computer interface.

Figure 4:
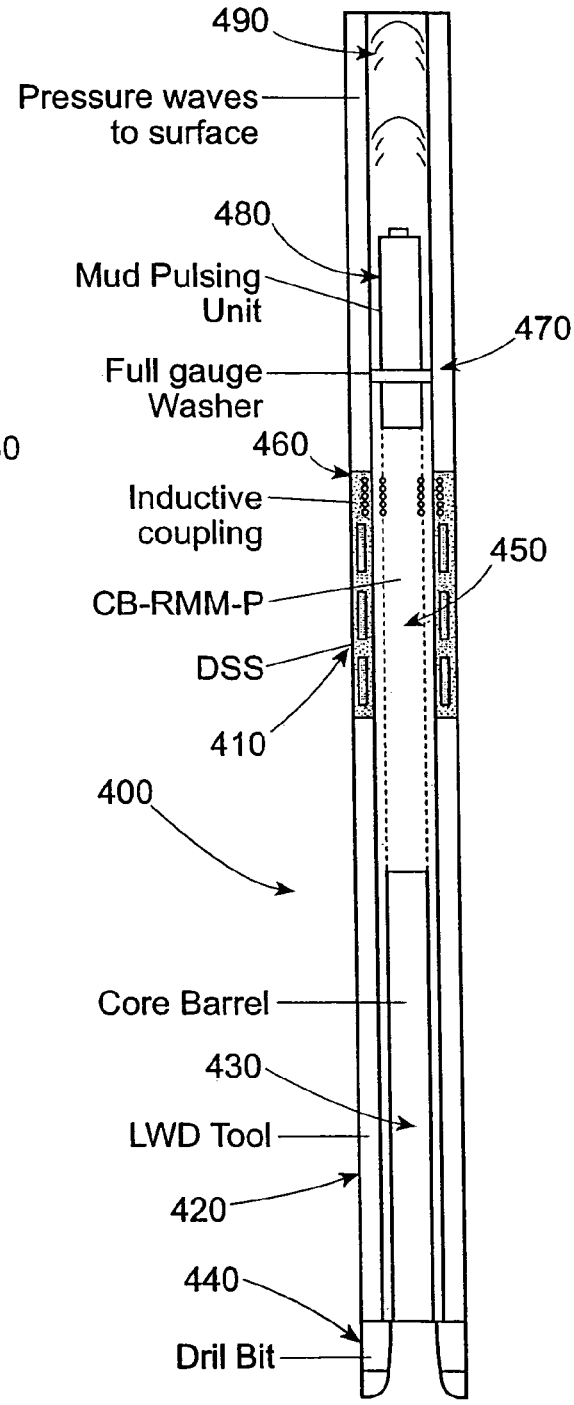
FIG. 4 is an illustration of an additional embodiment of a logging-while-coring downhole assembly with a mud pulsing unit.

FIG. 4 illustrates another embodiment of the present invention. Referring to FIG. 4, the logging-while-coring tool 400 includes a core barrel 430, a logging-while-drilling tool 420, a drill bit 440, a core barrel retrievable memory module 450, a full gauge washer 470, a mud pulsing telemetry unit 480, and an inductive coupler 470. The core barrel 430 and the retrievable memory module 450 are coupled to one another.

Logging-while-drilling tool 420 is similar in construction to the logging-while-drilling tool 320 of the previous embodiment. As such, logging-while-drilling tool 420 includes drilling sensor sub assembly 410 and one or more logging tools (not shown) that are known in the art. Data from the logging tools (e.g., weight on bit, torque, and pressure) are communicated to the drilling sensor sub assembly 410. As in the previous embodiment, the drilling sensor sub assembly 410 communicates the data through the inductive coupler 470. A retrievable memory module (not shown) of the core barrel retrievable memory module 350 recognizes and stores the signal received the inductive coupler 470.

Data received from the inductive coupler is also communicated to the mud pulsing telemetry unit 480. The mud pulsing telemetry unit 480 includes a circuit and transducer that receives the downhole data signal and produces a highly correlated pressure signal. The mud pulsing telemetry unit telemeters the data up the drill string to the surface. The transducer produces pressure waves 490 that propagate through the mud contained in the interior of the drill string. The transmission of downhole data to the surface occurs in real time.

The pressure waves 490 represent a binary signal that is decoded at the surface. In other embodiments of the present invention, the pressure waves 490 can represent an analog signal.

This embodiment can also include a core barrel retrievable memory module 450 which receives and stores downhole logging data. The core barrel retrievable memory module 450 can also be used as to buffer the data signal before transmission to the surface via the mud pulsing telemetry unit 480. The retrievable memory module contained therein can include one or more of a variety of memory storage devices. Examples of memory storage devices include random access memory (RAM), electronically erasable programmable read only memory (EEPROM), and flash RAM.

As with the previous embodiment, the core barrel retrievable memory module 450 can be brought to the surface during the retrieval of the core barrel 430. The data corresponding to the sample contained in the core barrel is retrieved at the surface through a computer interface.

Following the reduction to practice of the logging-while-coring system, the logging-while coring system was tested. A coring test through low-grade cement was successfully conducted prior to deployment of the system at sea.

Figure 5A:
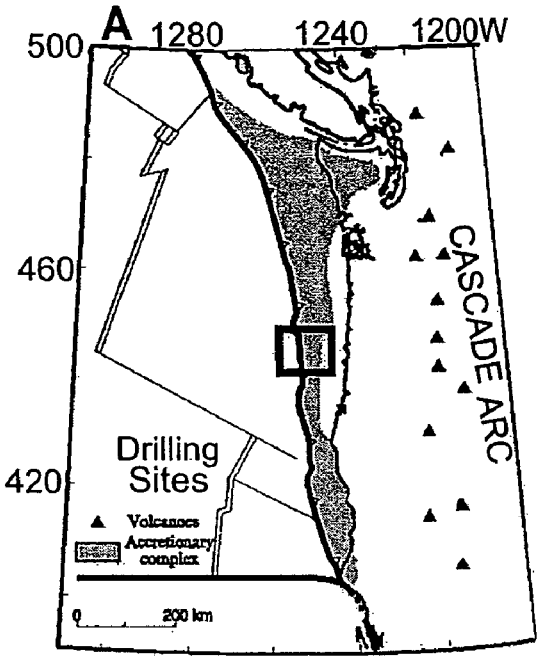
FIG. 5A is a representation of a location map of the Hydrate Ridge test site off the coast of Oregon.
Figure 5B:
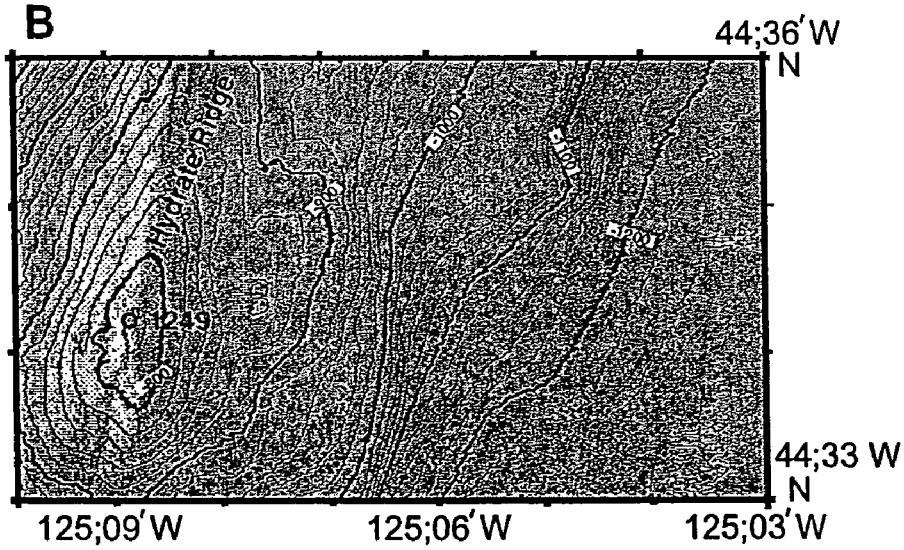
FIG. 5B is a bathymetrical representation of the Hydrate Ridge test site off the coast of Oregon.

Proof of concept ocean drilling test were performed during Ocean Drilling Program Leg 204 on Hydrate Ridge off the coast of Oregon. The logging-while-coring system was deployed on a vessel called D/V JOIDES Resolution for use on ODP Leg 204, offshore Oregon, in July 2002. The test was conducted in 788.5 m water depth at the crest of southern Hydrate Ridge at ODP Site 1249 (FIGS. 5A & 5B). Drilling proceeded to 30 m below sea floor where coring operations began with sequential 4.5-m, then 9-m-long cores recovered through gas hydrate-bearing clay sediments to 74.9 m depth. A 9 ⅞-inch-diameter four-cone bit (not shown) was used and the rotation rate increased from 15 to 45 RPM with depth. Average penetration rate was approximately 8 m/hr.

Eight cores were recovered from Hole 1249B with 32.9% recovery, on average, through a 45 m interval. Cores recovered using plastic liners have a slightly narrower diameter (2.35") than more standard cores, yet recovery as high as 67.8% was reached. Two 9-m (2.56" diameter) cores were taken without MDCB liners and achieved up to 42.3% recovery after being extruded from the barrel. Without liners, however, handling and further core processing and archiving is limited.

Figure 6:
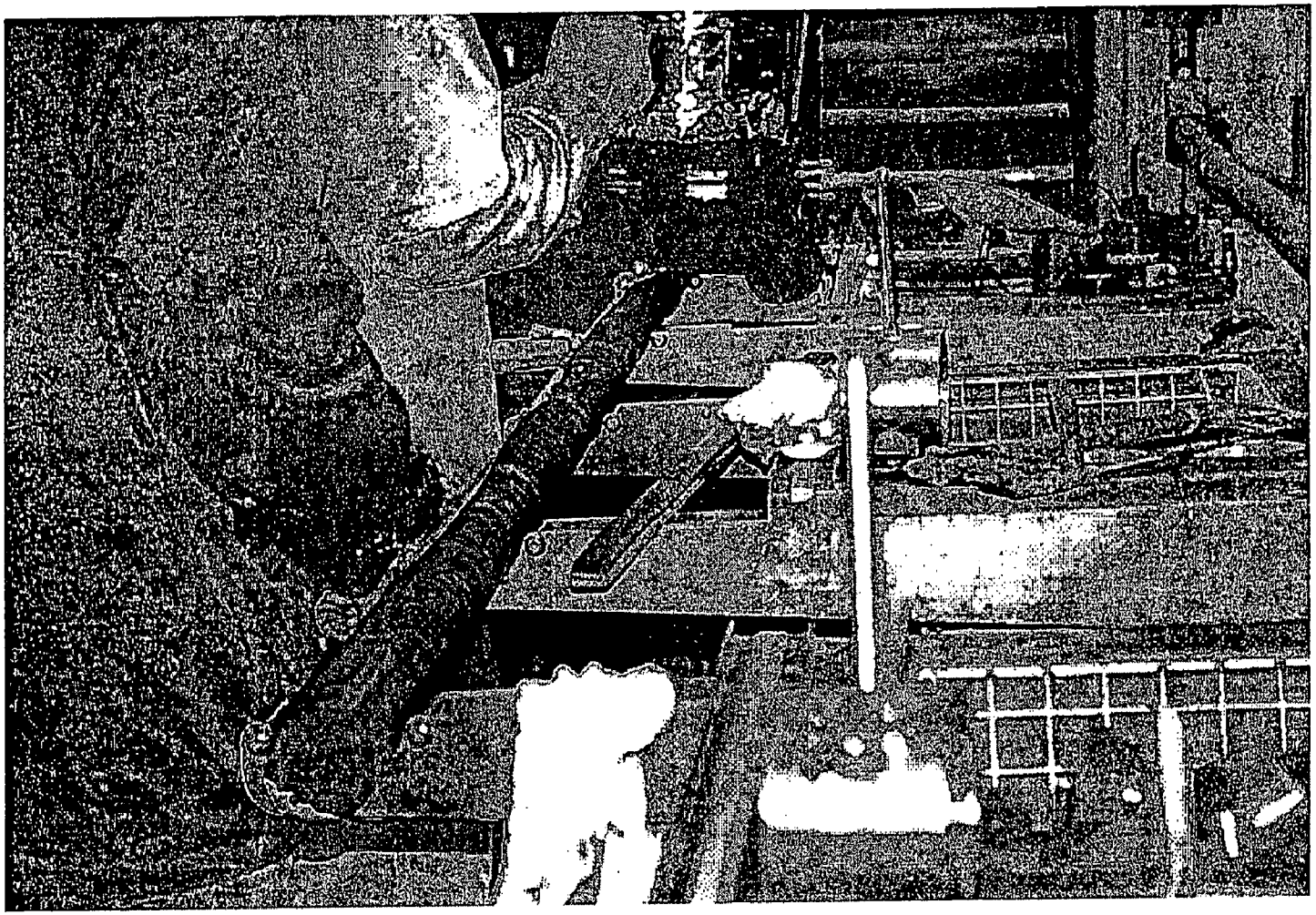
FIG. 6 is an illustration of core recovered using the logging-while-coring system.

All eight cores were processed and archived normally on board the D/V JOIDES Resolution. FIG. 6 illustrates the first core recovered from Hole 1249B prior to measurement and processing. Core measurements including density and magnetic susceptibility were made onboard the JOIDES Resolution using a multi-sensor track. Bulk density, porosity and grain density core measurements were made on discrete samples. The occurrence of gas hydrates in the core material and their rapid dissociation precluded the measurement of natural gamma activity in the cores. These measurements require an extended length of time to complete the measurement process.

High quality logs and image data were recorded in the downhole memory of the logging-while-coring tool over the entire 74.9 m drilled interval in Hole 1249B. The RAB-8 system was also calibrated post-deployment in salt water calibration tanks at Sugar Land, Tex. The tool functioned properly during this test and the calibration showed the field data are reliable.

Figure 7:
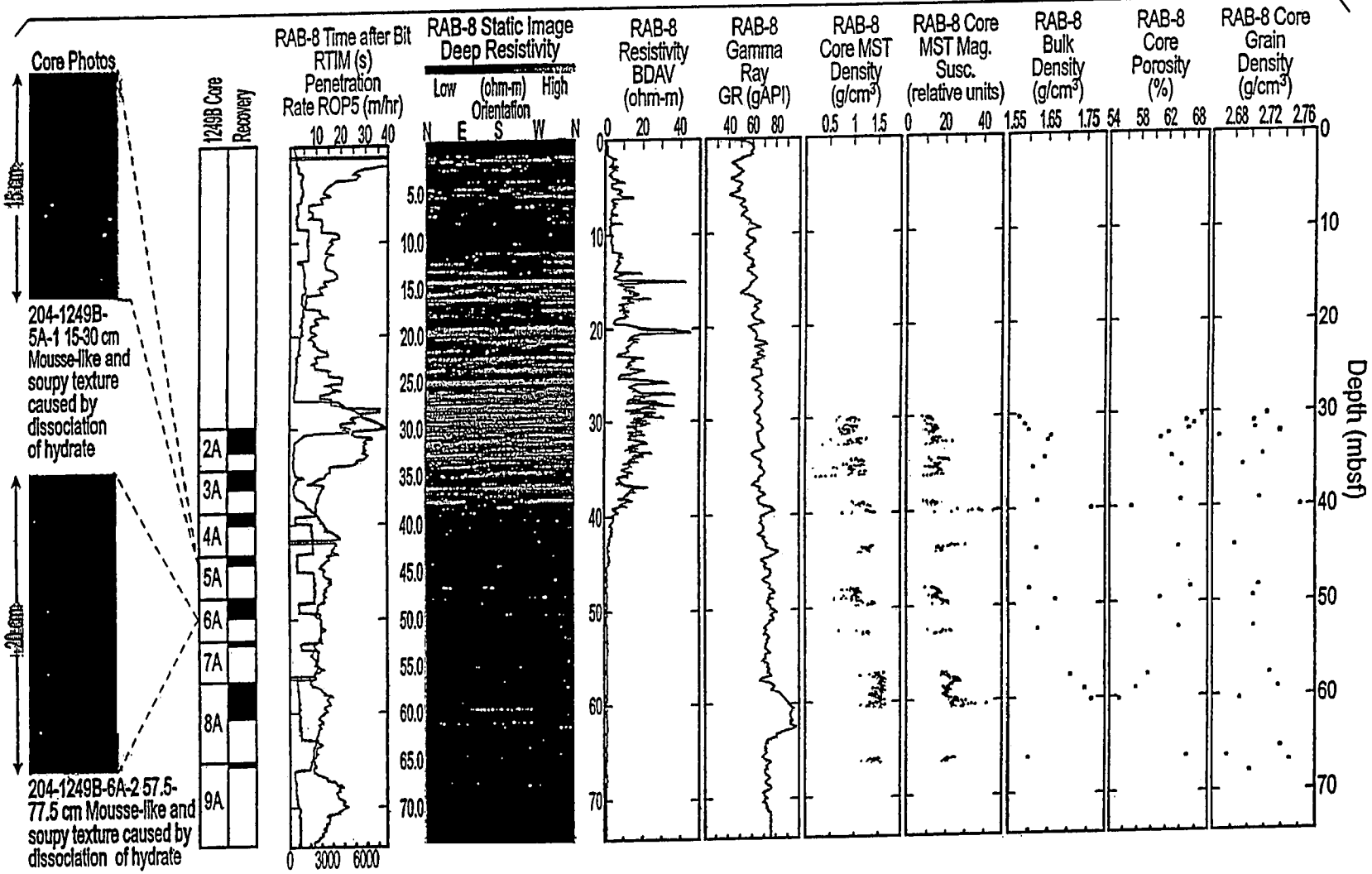
FIG. 7 is a representation of data acquired from Site 1249B including resistivity images, resistivity and gamma curves and data from core collected through the logging while coring system.

FIG. 7 shows a summary of the primary core and drilling data acquired in Hole 1249B including resistivity images, and the resistivity and gamma ray logs from the logging-while-coring system. Core measurements of discrete samples from Hole 1249B are presented at discrete depths from 29.9-75.0 m below seafloor (mbsf) as well as multi-sensor track core measurements. Core measurements have a depth accuracy of ±0.5 meters. Since core recovery averages only 32.9% in this hole, depth matching between core and log measurements may be somewhat imprecise at specific depths. Ties are made using density, magnetic susceptibility and gamma ray data, and for example, all three measurements increase near 60 mbsf, indicating a change in lithologic content.

Downhole drilling parameters recording during coring in Hole 1249B are also indicated in FIG. 7. Hole 1249B was drilled to maintain a rate of penetration of 20 m/hr over each cored interval. Weight-on-bit ranged widely, however, as it was difficult to control precisely in these shallow and soft sediments. The time after bit (of the LWD system measurements) varies due to the time required to drill and recover each core, and substantially more time than standard drilling or LWD operations without coring is required. The difference between drilling ahead and coring time may introduce some uncertainly in the core to log depth correlation.

Core photographs of core 5-A (43 mbsf) indicates a gas hydrate rich core that largely dissociated creating a "mousse"-like fabric. The reflective areas are an indication of where the gas hydrate existed. Core 6-A (49 mbsf) indicates a change in the composition of the cored material. The mixed recovery in these materials is reasonable given that the MDCB core barrel 220 is designed primarily for use in harder rocks. The MDCB system cuts core by rotation, filling of the barrel slowly as the bit advances. A piston-type core barrel is more conducive to high recovery of low-strength materials. The MDCB core barrel 220 will be modified in the future to shorten the core length and reduce friction as the core enters the barrel. These are important changes aimed at improving core recovery with this system.

Figure 8:
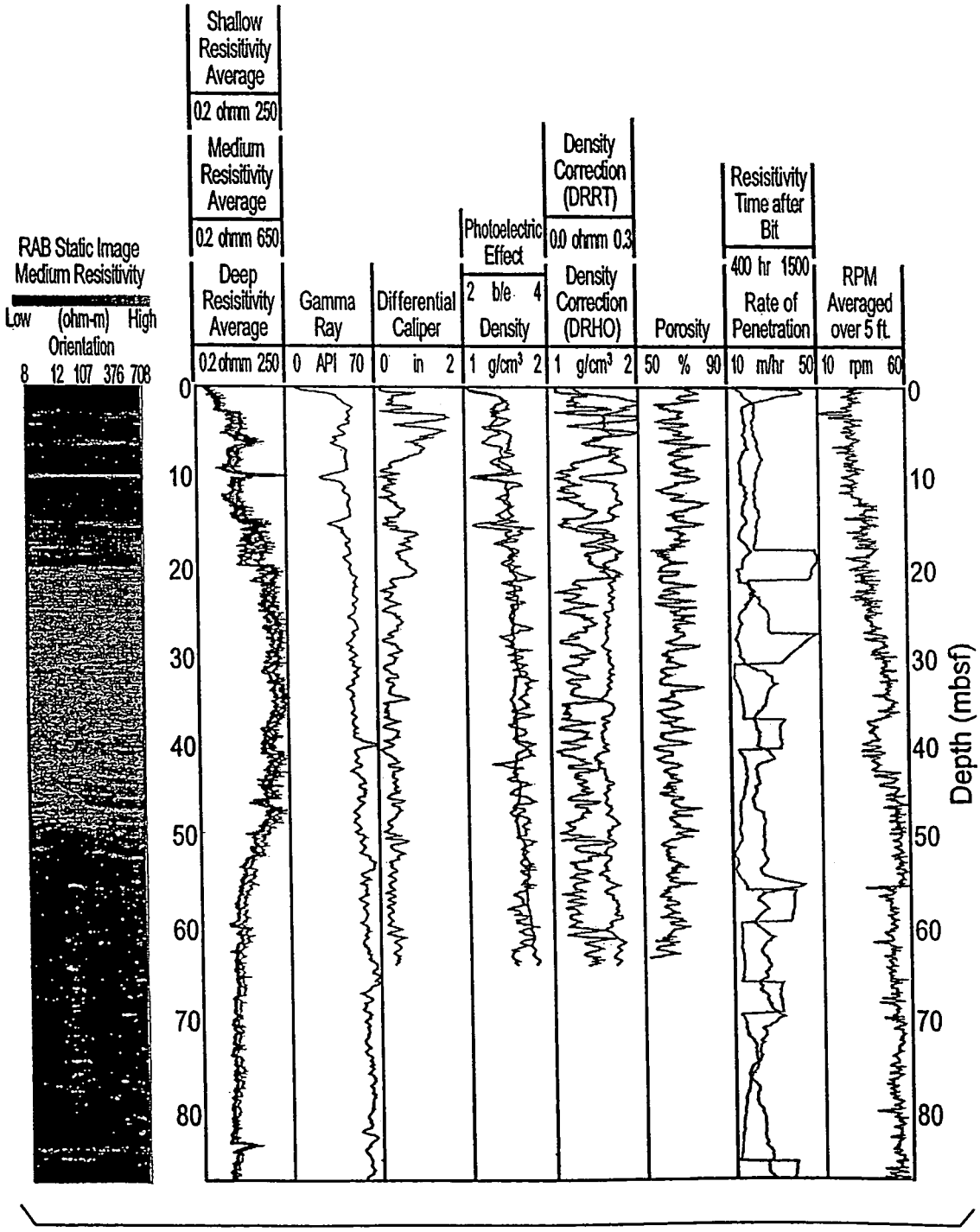
FIG. 8 is a representation of data acquired using the GVR-6 and VDN tools from Hole 1249A, adjacent to Hole 1249B.

A comprehensive suite of LWD data was acquired in nearby Hole 1249A using GeoVision Resistivity (GVR-6) TM and Vision Density Neutron (VDN) TM tools (FIG. 8) which are known in the art. The lateral offset between Hole 1249A and 1249B is 40 m. A difference of approximately 0.5 meters in water depth exists between the two sites. The logs from Hole 1249A show the rate of penetration and time after bit curves are lower than in Hole 1249B and remain relatively constant for the drilled interval (FIG. 8).

Figure 9:
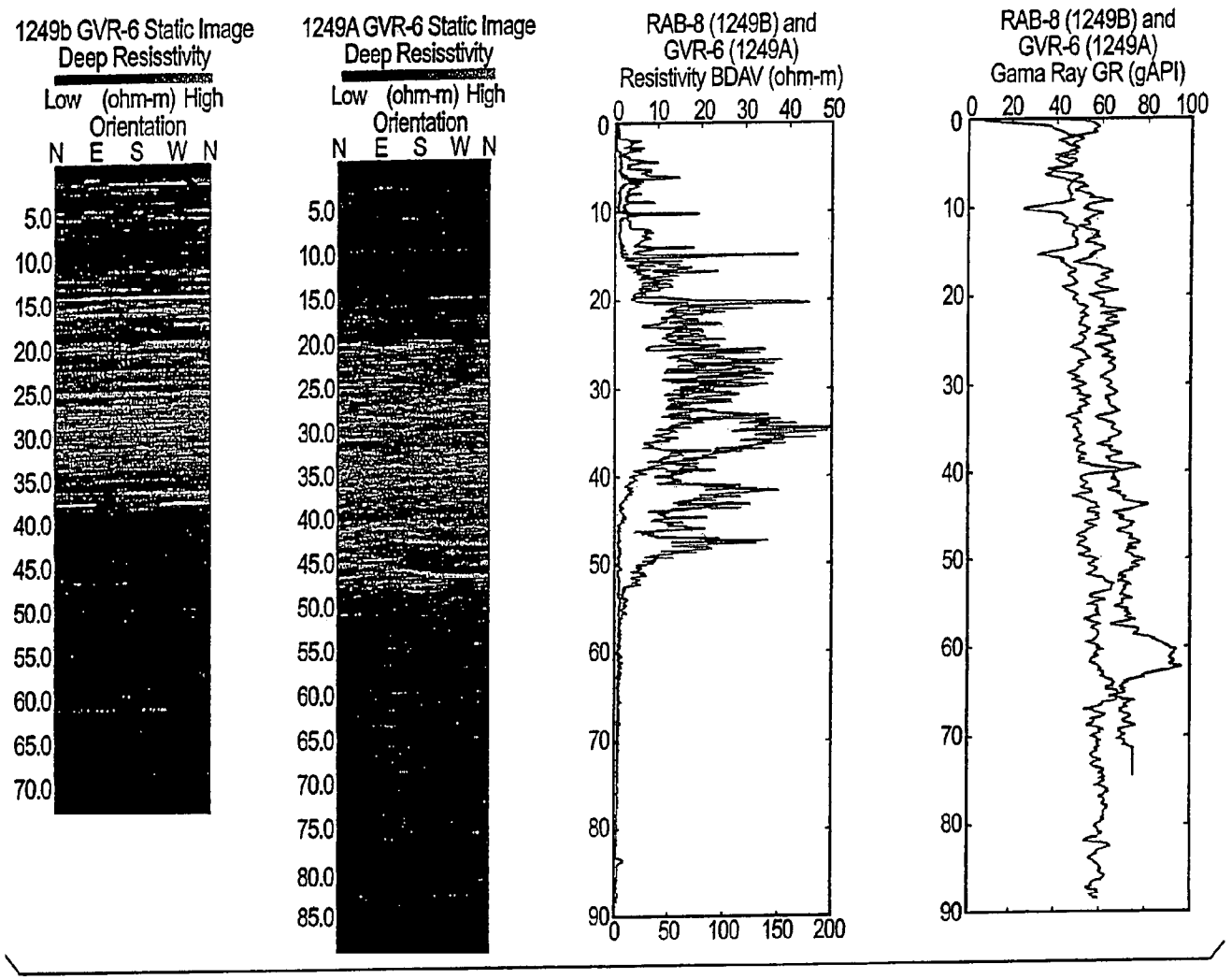
FIG. 9 is representation of a comparison of responses between the data acquired using the GVR-6 and VDN tools and logging-while-coring tools.

The logging-while-coring data collected in Hole 1249B are compared with GVR-6 data from nearby Hole 1249A in FIG. 9, which shows important similarities and differences. The large increase in resistivity in the upper interval in both holes corresponds to the presence of gas and gas hydrate. Some variation in the image quality between the holes may be associated with the greater time after bit for the logging-while-coring system measurements (e.g. coring versus drilling operations). The gamma ray shows a linear trend with an offset that may be attributed to the difference in lateral standoff between logging-while-coring and GVR-6 tools. In general, the image data in Hole 1249A and 1249B correlate well, with differences due to environmental conditions and lateral variations in geologic heterogeneity between the two sites.

The deployment of a new logging-while-coring system on Hydrate Ridge successfully acquired resistivity and gamma ray logs, and resistivity image simultaneously with core in Hole 1249B. This system offers the significant advantages of providing core and log data over the same drilled interval, and saving rig time. Time requirements for the logging while coring system are the same as for coring operations alone. Core recovery during this test reached 68.9% and averaged 32.8% over a 45 m drilled interval in shallow, soft marine sediments. Alternate deployments of the logging-while-coring system in harder rock environments offer the potential for improved core recovery using a motor driven core barrel. Core recovery in soft sediments may be increased by modifying other core barrels to fit within the 3.45 inch annulus of the core collar 210. Measurements on recovered core may be correlated directly with log data over the same drilled interval. LWD data from both conventional and while-coring operations at a nearby site agree well, and indicate the presence of gas and gas hydrate in clay rich sediments at this location.

The invention may be embodied in other specific forms without departing from the spirit or essential characteristics thereof. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

What is claimed is:

1. A method for obtaining logging measurements while coring using a bottomhole assembly having a collar and a core barrel disposed at least partially within the collar, the method comprising:

coring a wellbore; and while coring the wellbore, obtaining logging measurements for the wellbore from at least one logging sensor disposed on an outer surface of the collar;

wherein the at least one logging sensor measures a formation property of the wellbore.

2. The method of claim 1, further comprising communicating the logging measurements to a data transmission device.

3. The method of claim 2, further comprising communicating the logging measurements from the logging sensor to the data transmission device through an inductive coupling device.

4. The method of claim 2, further comprising transmitting the logging measurements with the data transmission device in real time.

5. The method of claim 1, further comprising storing the logging measurements in a memory storage device.

6. The method of claim 5, further comprising communicating the logging measurements from the logging sensor to the memory storage device through an inductive coupling device.

7. The method of claim 5, further comprising retrieving the core barrel.

8. The method of claim 7, further comprising retrieving the memory storage device with the core barrel, the memory storage device being disposed in the core barrel.

9. A method for performing logging operations while coring, the method comprising:

excavating a core sample;

capturing the core sample in a core barrel, the core barrel at least partially disposed within a collar;

activating at least one logging sensor disposed on an outer surface of the collar, each of the logging sensors being capable of detecting a property of a material that is disposed adjacent to the respective logging sensor; and obtaining sensor measurements from the at least one logging sensor for a material that is disposed adjacent to the at least one logging sensor.

10. The method of claim 9, further comprising communicating the sensor measurements to a data transmission device.

11. The method of claim 10, further comprising communicating the sensor measurements from the logging sensor to the data transmission device through an inductive coupling device.

12. The method of claim 10, further comprising transmitting the sensor measurements with the data transmission device in real time.

13. The method of claim 9, further comprising storing the sensor measurements in a memory storage device.

14. The method of claim 13, further comprising retrieving the core barrel.

15. The method of claim 14, further comprising retrieving the memory storage device with the core barrel, the memory storage device being disposed in the core barrel.

16. A method for detecting the presence of hydrocarbon in an earth formation, the method comprising:

coring a wellbore in an earth formation with an assembly comprising a collar and a core barrel at least partially disposed within the collar;

while coring the wellbore, obtaining measurements from a logging sensor disposed on an outer surface of the collar, the measurements being related to a formation property of the wellbore; and based on whether the measurements indicate the presence of a hydrocarbon in the earth formation, extracting the hydrocarbon from the earth formation.

17. The method of claim 16, wherein the hydrocarbon is oil.

18. The method of claim 16, wherein the hydrocarbon is gas.

19. The method of claim 16, wherein the assembly is disposed at a distal end of a drillstring.

20. The method of claim 16, wherein the logging sensor is a sensor selected from the group consisting of a resistivity sensor, a passive nuclear sensor, an active nuclear sensor, a gamma ray sensor, an electromagnetic wave sensor, an electric field telemetry sensor, an acoustics sensor, and a nuclear magnetic resonance sensor.

* * * * *

UNITED STATES PATENT AND TRADEMARK OFFICE

CERTIFICATE OF CORRECTION

PATENT NO. : 7,293,613 B2
APPLICATION NO. : 11/639551
DATED : November 13, 2007
INVENTOR(S) : David S. Goldberg et al.

It is certified that error appears in the above-identified patent and that said Letters Patent is hereby corrected as shown below:

On the Title Page of the Letters Patent:

At Column 1, Item (73) - Assignee, the name of the assignee should read as follows:

The Trustees of Columbia University <u>in the City of New York</u>, New York, NY (US)

Signed and Sealed this

First Day of April, 2008

JON W. DUDAS
*Director of the United States Patent and Trademark Office*